US005765571A

United States Patent [19]

Dinnel

[11] Patent Number: 5,765,571

[45] Date of Patent: Jun. 16, 1998

[54] FOUNDATION FOR A HAIR DRESSING

[76] Inventor: Sally Dinnel, 22424 Porreras, Mission Viejo, Calif. 92692

[21] Appl. No.: 291,443

[22] Filed: Aug. 17, 1994

[51] Int. Cl.[6] ..... A45D 2/14; A41G 5/00

[52] U.S. Cl. ..... 132/210; 132/262; 132/54; 132/264

[58] Field of Search ..... 132/246, 247, 132/251, 264, 273, 210, 245, 250, 222, 139, 146, 144, 148, 158, 126, 156, 122, 54, 262; D28/10, 25, 29, 39, 40, 41, 42

[56] References Cited

U.S. PATENT DOCUMENTS

D. 187,977 5/1960 Pastoret ..... D28/29
D. 282,295 1/1986 Harvey ..... D28/29
3,507,291 4/1970 Gaxiola ..... 132/210
5,303,723 4/1994 Schach ..... 132/246
5,458,108 10/1995 Jacobs ..... 132/144

*Primary Examiner*—Todd E. Manahan
*Assistant Examiner*—E. Robert
*Attorney, Agent, or Firm*—Gene Scott - Patent Law & Venture Group

[57] ABSTRACT

A hair dressing foundation to ease in the creation of a french twist hair style. The foundation comprises a small, flexible device, triangular in shape with the upper end of the device being concave in curvature. A plurality of tabs allows the user to securely attach the device to the back of the user's hair. The user may wrap and swirl the user's hair around the device to create a french twist hair style.

10 Claims, 3 Drawing Sheets

FOUNDATION FOR A HAIR DRESSING

BACKGROUND OF THE INVENTION

1. Field of the Invention

This invention relates to a foundation for a hair dressing commonly referred to as a French twist, and has for its object to provide an inexpensive and simple means comprised of few parts, but which will produce such a hair dressing. Other objects and advantages of the invention will be understood from the following description. This invention also relates to an article for use in hair styling and control and particularly to a hair arranging accessory and hair fastener as well as to improvements in hair dressing aids, particularly for creating French twists and similar dressings. The present invention is directed generally to hair dressings, and more particularly to a simple means to create a French twist without the expense of going to a beauty parlor or salon.

2. Description of the Prior Art

The present invention is particularly useful for a person having medium to long hair which presents a time consuming problem of management and control. It is frequently necessary for longer hair to be held out of the way for purposes of comfort, safety, sports or a variation of hairdos. A common expedient is to gather the elongated hair at the back of the head and fasten it into one or more "pony tails". Examples of this can be found in U.S. Pat. No. 971,519 issued to C. A. Brannen; U.S. Pat. No. 2,668,547 issued to R. E. Wille; and U.S. Pat. No. 2,818,870 issued to O. R. Francis. None of these prior inventions or any prior art known disclose an accessory having the features and characteristics of the present invention and which is as versatile and simple to manipulate.

The prior art has proposed a number of devices for uses as a foundation for hair dressings. Heretofore, such dressings have been specifically designed for chignon type or high styled coiffure types of hair dressings.

The prior art has also proposed relatively less simple foundations for hair dressings. However, the patented prior art has only had the person's hair moving in a vertical, i.e. up and down flow.

Other prior art includes the patent pending "Hairdini " Magic Styling Wand by EPI. This is a long narrow device with a semi-rigid center that can only be used with long hair on an adult 's head. The instant invention is much smaller so that a child can wear the device and it is much less cumbersome to use. The comb-like protrusions on the present invention also stop the user's hair from falling down from the device. The concave area on top of the present invention allows the user to curl the hair around the top of the device. This distinctly varies the style from the one created by the "Hairdini" device.

Numerous innovations for a foundation for hair dressing have been provided in the prior art that are described as follows. Even though these innovations may be suitable for the specific individual purposes to which they address, they differ from the present invention as hereinafter contrasted.

U.S. Pat. No. 4,103,693

Hair Arranging Accessory

Rose M. Reagan

A hair arranging accessory in the form of a flattened annulus or band of semirigid sheet material can be opened to receive a strand of hair and compressed to grip the strand.

An inside surface portion of the annulus is provided with a gripping surface to inhibit slipping of the strand, and a pin is projected through apertures in the annulus wall and the hair of user. The accessory affords means to form an instant and secure hairdo as well as a solid, attractive base for attachment of a hair-piece.

This prior art patent differs from the present invention in that in the present invention there is no pin or pins to keep the hair in place and along with a gripping surface, i.e. a fine nylon mesh, there are comb-like protrusions to retain the hair in its manipulated style. The prior art only has the gripping surface.

U.S. Pat. No. 3,693,637

Chignon Foundation

Abraham Sidelman

A chignon foundation or so-called rat is here formed on a knit sleeve of resilient nylon rolled into itself so as to have a central through opening. A captive rubber band surrounds the opening.In use, the wearer pulls her medium long hair through the opening, then spreads the hair over the foundation and pins it in place. The knit nylon foundation imparts to the chignon the soft and resilient feel of a chignon formed wholly of a greater quantity of the wearer's hair.

This prior art invention is specifically designed to create a chignon type of a hair style. In contrast to the present invention that uses a device to create a flowing, curled or twisted type of hair style.

U.S. Pat. No. 3,638,663

Adjustable Hair Foundation

Deloris J. Harbison

A hair foundation or lift for application to a lady's head, having spaced-apart slats which extend upwardly from the scalp, and over which the hair, located between the slats, is drawn for bouffanting or puffing the hair. The foundation includes a base member or bar to which the slats are detachable and adjustably connected, enabling the slats to be disposed in vertical planes or inclined in a direction corresponding to the direction that the hair is drawn over the slats. The base member may include detachable sections, each capable of supporting a slat for increasing the length of the foundation and the number of the slats utilized. A rod detachable engages through the ends of the slats, disposed remote from the base member, for confining the hair between said rod and the base member. Clips carried by the base member are clamped to the hair for securing the foundation in a desired location on the head. This invention is designed specifically for creating a bouffanting or puffing the hair. This invention is placed on top of the head whereas the present invention is placed in the back of the head in order to create hair styles that are close to the head.

U.S. Pat. No. 3,452,761

Hair Support

Irving Siegel

A hair support comprising a frame of resilient plastic material to nest on the head of a wearer, said frame having a first and a second comb disposed on opposite sides of the frame and extending outwardly thereof so that the frame may be resiliently flexed to draw the combs together for subsequent outward movement so that the combs secure themselves in the hair of a wearer to provide a support to raise hair combed over the frame.

In the above prior art invention, the user's hair is pulled through the frame and combed over the device, whereas in the present invention, the user's hair is wrapped or curled around the device for a tight and secure form of hair style.

U.S. Pat. No. 2,765,798

Chignon Foundation

Martha L. Carvell

This invention relates to a chignon foundation and more specifically provides a device for forming and maintaining a hair roll for use by women when they are arranging their hair. The present invention does not profess to be able to create a chignon type of hair style from the use of the invention as this prior art invention does not profess to be able to create any type of curling or twisting form of hair styles.

SUMMARY OF THE INVENTION

The foundation for a hair dressing comprises a hair dressing device, mainly rectangular in shape with a top, a bottom, a right side and a left side of such that the hair dressing device curves in on the right side of the hair dressing device laterally from the top to the bottom of the hair dressing device thus allowing a person's hair to be wrapped around the hair dressing device order to enhance the persons hair.

The hair dressing device has an upper tab and a lower tab that is attached to the lower back of the hair dressing device allowing easy attachment to person's hair and a flexible rigid insert enclosed within the hair dressing device in order for the foundation to mold and conform to the user's head.

The hair dressing device has also a plurality of comb-like protrusions surrounding the right, bottom and top in order to keep the user's hair in place and easy the use of curling the person's hair around the foundation.

Accordingly, it is an object of the present invention to provide a foundation for a hair dressing. More particularly, it is an object of the present invention to provide a simple and inexpensive means for a person to curl their hair in a French twist style hair-do. A further object of the present invention is to provide a hair arranging accessory which enables the user to attain a virtually instant hairdo with minimal manipulation and expense. Another object of the invention is to provide a solid base for various hair styles and arrangements. Still another object of the present invention is to provide a hair arranging accessory as set forth above having a tactile locating means to aid the user in manipulating the accessory at the back of the head.

In keeping with these objects, and with others which will become apparent hereinafter, one feature of the present invention resides, briefly stated, in the semi-rigid material enclosed in the foundation in order for the person using the foundation to mold the device around the back of the head to conform to the head.

In accordance with another feature of the present invention, the small size and light weight of the foundation allows small person's such as children to wear and use the device. Another feature of the present invention is that the curvature on one side simulates the flowing appearance of the French twist style. Yet another feature of the present invention is that the comb-like protrusions surrounding three sides of the foundation easy the curling and placement of the person's hair and allows the person to maintain the hairstyle for hours without the style falling apart.

The inventor has submitted under the Disclosure Document Program disclosure #355186, dated 5/31/94 entitled "Sleek Swirlz, French Twist Hair Style Enhancer-Shaper".

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

DETAILED DESCRIPTION OF THE PREFERRED EMBODIMENT

Figure 1:
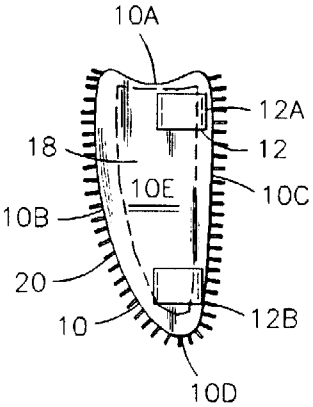
FIG. 1 shows the hair dressing device in elevation.

Firstly, referring to FIG. 1 showing the hair dressing device in elevation exhibiting the following features: hair dressing device 10 mainly triangular in shape with rounded edges allows the person's hair 16 to be wrapped around the hair dressing device 10 in such a fashion as to simulate a French twist hair style in order to enhance the look of the hair; top of hair dressing device 10A is concave in the center to permit curled top of person's hair 16C to be placed within the crevice; right side of hair dressing device 10B is gradually sloped towards the left side of hair dressing device 10C as moving from top of hair dressing device 10A to bottom of hair dressing device 10D; left side of hair dressing device 10C maintains a vertical posture moving from top of hair dressing device 10A to bottom of hair dressing device 10D; bottom of hair dressing device 10D ends in a rounded point; center area of hair dressing device 10E is convex moving from the right side of hair dressing device 10B to the left side of hair dressing device 10C; hair dressing device tabs 12 are placed next to the back of the person's hair 16 so that the hair dressing device holding bobby pins 14D secure the hair dressing device 10 to the person's hair 16 close to the rear of the person's head; hair dressing device upper tab 12A is placed next to the back of the person's hair 16 so that the hair dressing device holding bobby pins 14D secure the hair dressing device 10 to the person's hair 16 close to the rear of the person's head; and hair dressing device lower tab 12B is placed next to the back of the person's hair 16 so that the hair dressing device holding bobby pins 14D secure the hair dressing device 10 to the person's hair 16 close to the rear of the person's head.

Figure 2:
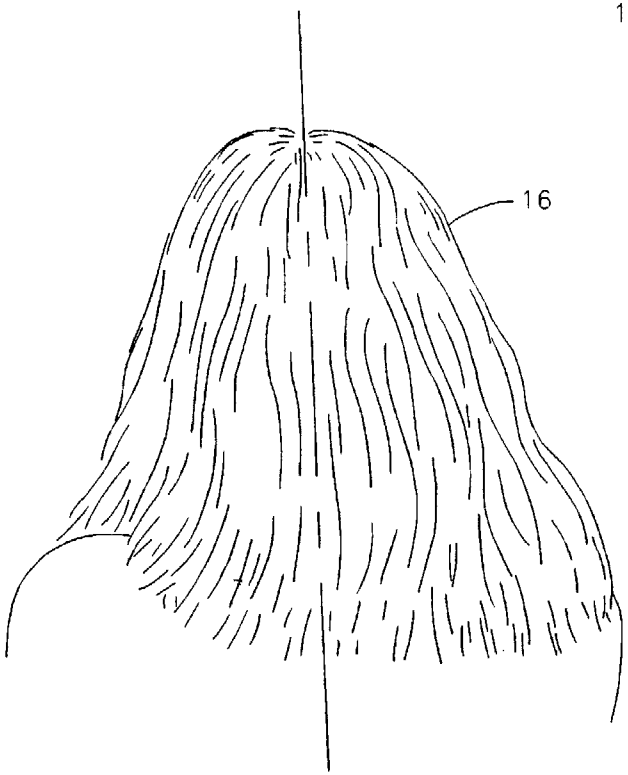
FIG. 2 is a rear view of the person's head and hair prior to using the hair dressing device.

Now, referring to FIG. 2 being a rear view of the person's head and hair prior to using the hair dressing device exhibiting the following features: person's hair 16 is brushed in such a manner as to allow use of the hair dressing device 10.

Figure 3:
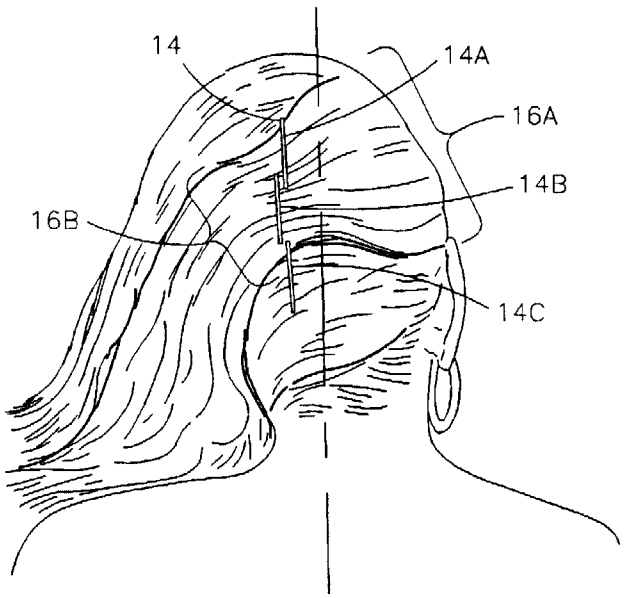
FIG. 3 is a rear view of the person's head and hair brushed and pinned in preparation for the hair dressing device.

Now, referring to FIG. 3 being a rear view of the person's head and hair brushed and pinned in preparation for the hair dressing device exhibiting the following features: placement bobby pins 14 holds the person's hair secured to head 16A giving the person's hair not secured to head 16B the proper position to allow use of the hair dressing device 10; upper hair placement bobby pins 14A holds the upper area of the person's hair secured to head 16A giving the person's hair not secured to head 16B the proper position to allow use of the hair dressing device 10; middle hair placement bobby pins 14B holds the middle area of the person's hair secured to head 16A giving the person's hair not secured to head 16B the proper position to allow use of the hair dressing device 10; lower hair placement bobby pins 14C holds the lower area of the person's hair secured to head 16A giving the person's hair not secured to head 16B the proper position to allow use of the hair dressing device 10; hair dressing device holding bobby pins 14D are placed vertically through the hair dressing device upper tab 12A and the hair dressing device lower tab 12B to secure the hair dressing device 10 to the person's hair not secured to head 16B; person's hair 16 is brushed in such a manner as to allow use of the hair dressing device 10; person's hair secured to head 16A in a cross-wise fashion in such a manner as to allow use of the hair dressing device 10; and person's hair not secured to head 16B brushed in such a manner as to allow use of the hair dressing device 10.

Figure 4:
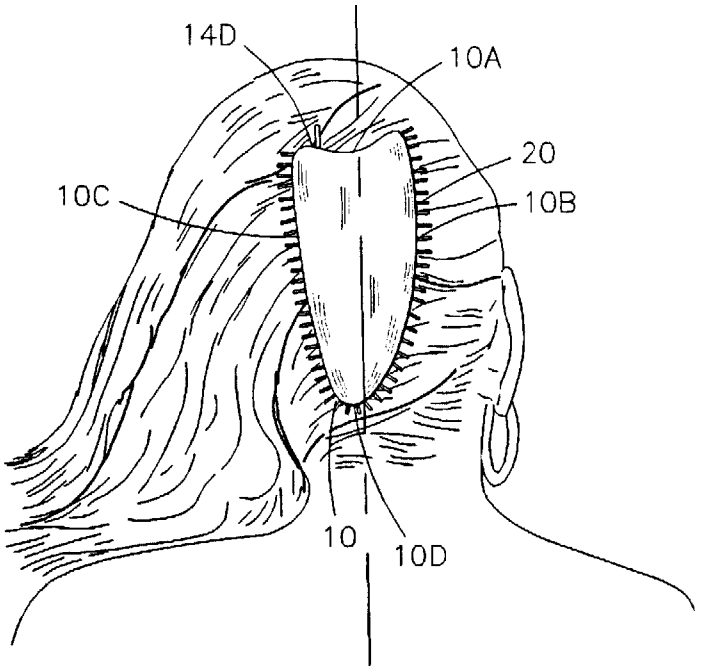
FIG. 4 is a rear view of the person's head and hair showing proper placement of the hair dressing device.

Now, referring to FIG. 4 being a rear view of the person's head and hair showing proper placement of the hair dressing device exhibiting the following features: hair dressing device 10 mainly triangular in shape with rounded edges allows the person's hair 16 to be wrapped around the hair dressing device 10 in such a fashion as to simulate a French twist hair style in order to enhance the look of the hair; top of hair dressing device 10A is concave in the center to permit curled top of person's hair 16C to be placed within the crevice; right side of hair dressing device 10B is gradually sloped towards the left side of hair dressing device 10C as moving from top of hair dressing device 10A to bottom of hair dressing device 10D; left side of hair dressing device 10C maintains a vertical posture moving from top of hair dressing device 10A to bottom of hair dressing device 10D; bottom of hair dressing device 10D ends in a rounded point; center area of hair dressing device 10E is convex moving from the right side of hair dressing device 10B to the left side of hair dressing device 10C; hair dressing device holding bobby pins 14D are placed vertically through the hair dressing device upper tab 12A and the hair dressing device lower tab 12B to secure the hair dressing device 10 to the person's hair not secured to head 16B; bendable insert 18 enclosed in the hair dressing device 10 giving flexibility and support: and comb-like protrusions 20 for the person's hair not secured to head 16B to flow around the hair dressing device 10 to maintain the style.

Figure 5:
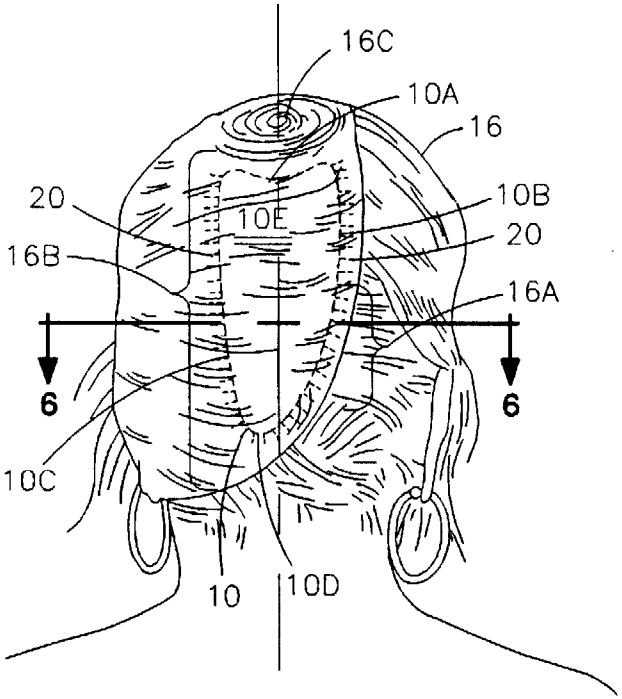
FIG. 5 is a rear view of the person's head and hair with the person's hair wrapped around the hair dressing device.

Now, referring to FIG. 5 being a rear view of the person's head and hair with the person's hair wrapped around the hair dressing device exhibiting the following features: hair dressing device 10 mainly triangular in shape with rounded edges allows the person's hair 16 to be wrapped around the hair dressing device 10 in such a fashion as to simulate a French twist hair style in order to enhance the look of the hair; top of hair dressing device 10A is concave in the center to permit curled top of person's hair 16C to be placed within the crevice; right side of hair dressing device 10B is gradually sloped towards the left side of hair dressing device 10C as moving from top of hair dressing device 10A to bottom of hair dressing device 10D; left side of hair dressing device 10C maintains a vertical posture moving from top of hair dressing device 10A to bottom of hair dressing device 10D; bottom of hair dressing device 10D ends in a rounded point; center area of hair dressing device 10E is convex moving from the right side of hair dressing device 10B to the left side of hair dressing device 10C; person's hair 16 is brushed in such a manner as to allow use of the hair dressing device 10; person's hair secured to head 16A in a cross-wise fashion in such a manner as to allow use of the hair dressing device 10; person's hair not secured to head 16B brushed in such a manner as to allow use of the hair dressing device 10; curled top of person's hair 16C to fit into top of hair dressing device 10A; bendable insert 18 enclosed in the hair dressing device 10 giving flexibility and support; and comb-like protrusions 20 for the person's hair not secured to head 16B to flow around the hair dressing device 10 to maintain the style.

Figure 6:
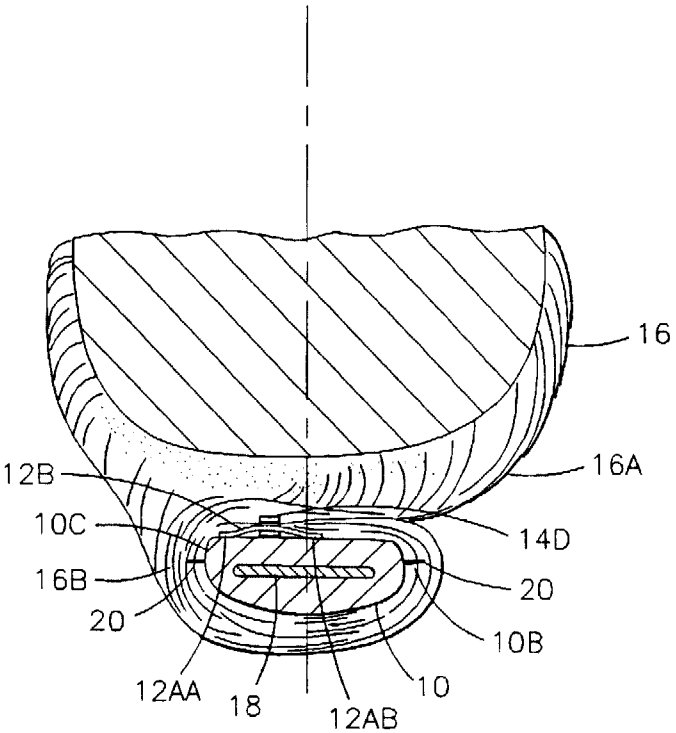
FIG. 6 shows a cross-section view along lines 6—6 in FIG. 5.

Now, referring to FIG. 6 showing a cross-section view along lines 6—6 in FIG. 5 exhibiting the following features: hair dressing device 10 mainly triangular in shape with rounded edges allows the person's hair 16 to be wrapped around the hair dressing device 10 in such a fashion as to simulate a French twist hair style in order to enhance the look of the hair; right side of hair dressing device 10B is gradually sloped towards the left side of hair dressing device 10C as moving from top of hair dressing device 10A to bottom of hair dressing device 10D; left side of hair dressing device 10C maintains a vertical posture moving from top of hair dressing device 10A to bottom of hair dressing device 10D; hair dressing device lower tab 12B is placed next to the back of the person's hair 16 so that the hair dressing device holding bobby pins 14D secure the hair dressing device 10 to the person's hair 16 close to the rear of the person's head left tab attachment 12AA for securing hair dressing device lower tab 12B to hair dressing device 10; right tab attachment 12AB for securing hair dressing device lower tab 12B to hair dressing device 10; person's hair 16 is brushed in such a manner as to allow use of the hair dressing device 10; hair dressing device holding bobby pins 14D are placed vertically through the hair dressing device upper tab 12A and the hair dressing device lower tab 12B to secure the hair dressing device 10 to the person's hair not secured to head 16B; person's hair secured to head 16A in a cross-wise fashion in such a manner as to allow use of the hair dressing device 10; person's hair not secured to head 16B brushed in such a manner as to allow use of the hair dressing device 10; bendable insert 18 enclosed in the hair dressing device 10 giving rigidity, flexibility and support; and comb-like protrusions 20 for the person's hair not secured to head 16B to flow around the hair dressing device 10 to maintain the style.

Figure 7:
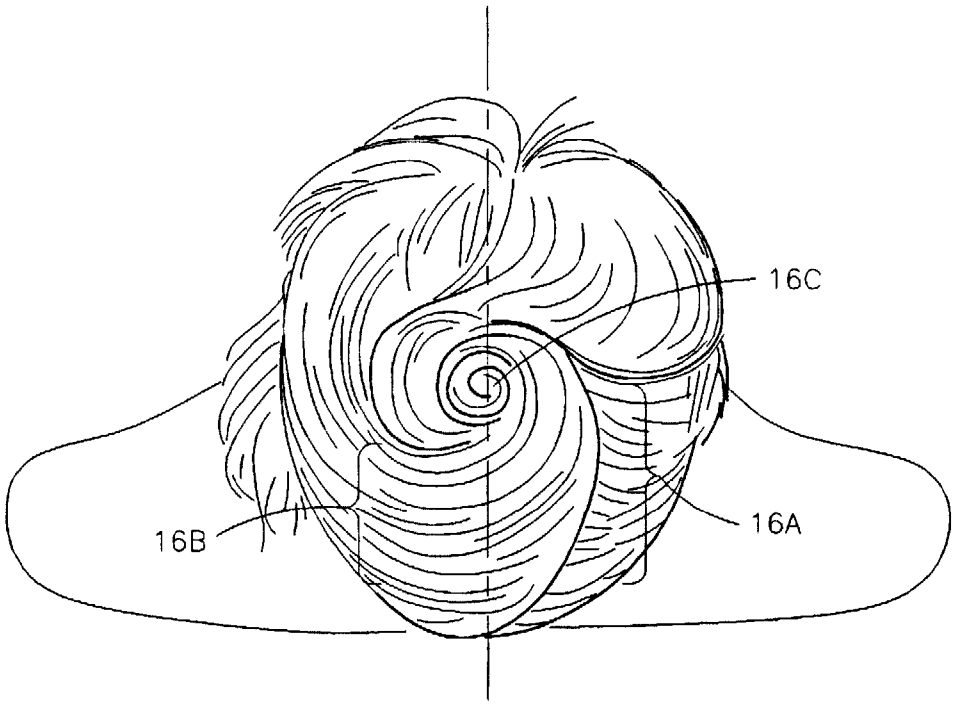
FIG. 7 is a plan view looking down on the finished hair construction.

Now, referring to FIG. 7 is a plan view looking down on the finished hair construction exhibiting the following features: person's hair secured to head 16A in a cross-wise fashion in such a manner as to allow use of the hair dressing device 10; person's hair not secured to head 16B brushed in such a manner as to allow use of the hair dressing device 10; and curled top of person's hair 16C to fit into top of hair dressing device 10A.

The foundation for a hair dressing shall be manufactured individually and in combination from a group of materials consisting of plastic, plastic composites, closed-cell foam material, open-cell foam material, foam rubber, polyurethane, and polyethylene. The hair dressing device shall be formed of a surface finish capable of entangling with said person's hair holding said device to said hair. The hair dressing device tabs shall be constructed from a group of materials individually or in combination including: plastic, plastic composites, fabric, elastic strips and rubber. The comb-like protrusions being constructed shall be manufactured from a group of materials individually or in combination including: plastic, plastic composites, wood, carbon-graphite, metal, metal alloys, and fiberglass. The foundation insert being constructed shall be manufactured from a group of materials individually or in combination including: plastic, plastic composites, metal, metal alloys, and fiberglass.

It will be understood that each of the elements described above, or two or more together, may also find a useful application in other types of constructions differing from the type described above.

While the invention has been illustrated and described as embodied in a foundation for a hair dressing, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A foundation for a hair dressing comprising:

a) a hair dressing device mainly triangular body shape having:

i) a top of said hair dressing device being concave in curvature allowing person's hair to be twirled within said concave, ii) a bottom of said hair dressing device being bluntly pointed at an apex, iii) a right side of said hair dressing device being convex in curvature, and iv) a left side of said hair dressing device being slightly convex in curvature; and b) a plurality of hair dressing device tabs, at least one being an upper tab attached to an upper back of said hair dressing device thereon allowing affixment to a person's hair and at least one other being a lower tab attached to a lower back of said hair dressing device thereon allowing affixment to said person's hair.

2. The foundation for a hair dressing as described in claim 1, further including a flexible insert enclosed within said hair dressing device.

3. The foundation for a hair dressing as described in claim 2, whereas said flexible insert being constructed from a group of materials individually and in combination including plastic, plastic composites, mental, metal alloys and fiberglass.

4. The foundation for a hair dressing as described in claim 1, further including a plurality of comb-like protrusions surrounding said right side, said left side, of said hair dressing device said bottom and still further surrounding a tip of said hair dressing device functioning to hold said person's hair thereon and separate strands of said person's hair therein.

5. The foundation for a hair dressing as described in claim 4, whereas said hair dressing device being manufactured individually and in combination from a group of materials consisting of plastic, plastic composites, closed-cell foam material, open-cell foam material, foam rubber, polyurethane, and polyethylene.

6. The foundation for a hair dressing as described in claim 4, whereas said comb-like protrusions being rigid in structure.

7. The foundation for a hair dressing as described in claim 6, whereas said comb-like protrusions being constructed from a group of materials individually and in combination including plastic, plastic composites, wood, carbon-graphite, metal, metal alloys, and fiberglass.

8. The foundation for a hair dressing as described in claim 1, whereas said hair dressing device is formed of a material having a surface finish capable of entangling with said persons hair, holding said device to said hair.

9. The foundation for a hair dressing as described in claim 1, whereas said hair dressing device tabs being constructed from a group of materials individually and in combination including plastic, plastic composites, fabric, elastic strips, and rubber.

10. A method of utilizing a foundation for a hair dressing comprising the steps of:

a) brushing a back of a person's hair in a lateral movement;

b) affixing a plurality of bobby pins to said person's back of hair to keep said hair in place;

c) placing said foundation against rear of person's head;

d) affixing said foundation to said person's back of head with a plurality of bobby pins secured through a plurality of tabs in said foundation; and e) twirling said person's hair around said foundation covering said foundation with said hair to form a French twist style design.

* * * * *